US007691242B2

(12) United States Patent
Bulan et al.

(10) Patent No.: US 7,691,242 B2
(45) Date of Patent: Apr. 6, 2010

(54) ELECTROCHEMICAL HALF-CELL

(75) Inventors: Andreas Bulan, Langenfeld (DE); Fritz Gestermann, Leverkusen (DE); Peter Fabian, Gelnhausen (DE)

(73) Assignee: Bayer MaterialScience AG, Leverkusen (DE)

( * ) Notice: Subject to any disclaimer, the term of this patent is extended or adjusted under 35 U.S.C. 154(b) by 107 days.

(21) Appl. No.: 12/141,399

(22) Filed: Jun. 18, 2008

(65) Prior Publication Data

US 2008/0296153 A1 Dec. 4, 2008

Related U.S. Application Data

(63) Continuation of application No. 10/882,644, filed on Jul. 2, 2004, now abandoned.

(30) Foreign Application Priority Data

Jul. 4, 2003 (DE) ..... 103 30 232

(51) Int. Cl.
*C25B 9/08* (2006.01)

(52) U.S. Cl. ..... 204/252; 204/283; 204/286.1; 204/288.2

(58) Field of Classification Search ..... 204/252, 204/283, 286.1, 288.2; 429/34, 35, 36, 38, 429/40, 44
See application file for complete search history.

(56) References Cited

U.S. PATENT DOCUMENTS

| | | | | |
|---|---|---|---|---|
| 5,693,202 | A | 12/1997 | Gestermann et al. | |
| 5,933,016 | A * | 8/1999 | Kauffman et al. | 324/698 |
| RE37,307 | E * | 8/2001 | Bahar et al. | 204/296 |
| 6,399,236 | B1 * | 6/2002 | Furuya | 429/40 |
| 7,404,878 | B2 * | 7/2008 | Katayama et al. | 204/283 |
| 2004/0251128 | A1 * | 12/2004 | Weuta et al. | 204/288.2 |

FOREIGN PATENT DOCUMENTS

| | | |
|---|---|---|
| DE | 3710168 | 10/1988 |
| DE | 44441144 | 9/1996 |
| EP | 1029946 | 8/2000 |
| EP | 1041176 | 10/2000 |

* cited by examiner

*Primary Examiner*—Bruce F Bell
(74) *Attorney, Agent, or Firm*—Connolly Bove Lodge & Hutz LLP

(57) ABSTRACT

The present invention describes an electrochemical half-cell, comprising a gas space, an electrolyte space and a gas diffusion electrode in the form of a cathode or anode. The gas diffusion electrode separates the gas space from the electrolyte space and comprises an electrically conductive substrate and an electrochemically active coating. The gas diffusion electrode includes a coating-free edge region and is connected to a support structure in the coating-free edge region via an electrically conductive plate, which covers at least the coating-free edge region as well as a coated edge region.

22 Claims, 3 Drawing Sheets

ELECTROCHEMICAL HALF-CELL

CROSS REFERENCE TO RELATED APPLICATIONS

This application is a continuation of U.S. patent application Ser. No. 10/882,644 filed Jul. 2, 2004 now abandoned, which claims priority under 35 USC 119 to German Application No. 103 30 232.8 filed Jul. 4, 2003, the content of which is incorporated herein by reference in its entirety.

BACKGROUND OF THE INVENTION

1. Field of the Invention

The invention relates to an electrochemical half-cell, in particular for the electrolysis of an aqueous alkali metal chloride solution.

2. Description of Related Art

DE-A-44 44 114 discloses an electrochemical half-cell for the electrolysis of an aqueous alkali metal chloride solution, with a plurality of gas pockets lying above one another, there being a gas diffusion electrode ("GDE") between each gas pocket and the electrolyte space. The gas diffusion electrodes are fastened and sealed to structural elements of the half-cell with the aid of support elements, which are designed for example as terminal strips. A particular disadvantage associated with a clamping connection is that sufficient sealing of the gas space from the electrolyte space generally cannot be ensured in the long term. Working lives longer than three years are generally necessary for industrial implementation, since economic viability is difficult to achieve otherwise. Furthermore, small pressure surges that occur in the electrolyser can loosen the clamping connection of the GDE. This compromises the integrity of the connection, so that gas from the gas pockets escapes into the electrolyte space or the electrolyte floods the gas pockets.

EP-A-1 029 946 describes a gas diffusion electrode, having of a reactive layer and a gas diffusion layer and a collector plate, for example, a silver mesh. The coating does not completely cover the collector plate, but leaves a coating-free edge protruding. A thin metal plate in the form of a frame, preferably made of silver, is applied to the gas diffusion electrode so that the metal frame covers as small as possible an area of the electrochemically active coating. The frame protruding from the gas diffusion electrode is used for connecting the gas diffusion electrode to the housing of the half-cell, for example, by welding. This method of making contact is complicated and covers up some of the GDE surface, so that the local current density of the free GDE surface is increased and the performance of the electrolyser is reduced owing to a higher electrolysis voltage. The complicated installation furthermore entails high manufacturing costs of the electrolyser.

EP-A 1 041 176 also describes a gas diffusion electrode with a coating-free edge. The gas diffusion electrode in this case is shown connected to the current collector frame of the cathode half-cell by welding in the coating-free edge region. The cavities between two neighboring gas diffusion electrodes are sealed with an alkali-resistant material. A disadvantage of this installation method relates to problems with the sealing material required to obtain sufficient sealing. The sealing effect decreases over the course of operation of the electrolyser, so that the useful life is insufficient terms of economics.

Since the gas diffusion electrode needs to be connected to the electrolyser, a low-impedance connection should typically be ensured, especially for industrial application. Even very minor junction resistances can lead to significant economic disadvantages in industrial electrolysis. Low-impedance connections can generally be produced by short current paths, as mentioned, for example, in the DE-A-44 44 114. A low-impedance connection may also be obtained by a metal-metal contact, e.g. when the two or more metals are connected by soldering or welding. Therefore, the substrate of the GDE is optimally connected to a support structure of the electrolyser using a low-impedance connection made by welding or soldering. However, an effective seal also has to be achieved as well.

SUMMARY OF THE INVENTION

It was an object of the present invention to provide a gas diffusion electrode in an electrochemical half-cell with low-impedance, i.e. the electrode is included in such a way that the cell possesses a low, or even the lowest possible resistance, while, at the same time, providing a seal between the gas space and the electrolyte space. A gas diffusion electrode of the present invention is preferably configured so that gas from the gas pocket cannot enter the electrolyte space and electrolyte from the electrolyte space cannot enter the gas pocket. At the same time, any loss of electrochemically active area of the gas diffusion electrode should preferably be as small as possible. Furthermore, the installation should preferably be as easy as possible to carry out logistically and/or technically.

In accordance with one or more of these objects and others, the present invention relates to an electrochemical half-cell comprising (i) at least one gas space, (ii) an electrolyte space and (iii) a gas diffusion electrode in the form of a cathode or anode, which separates the gas space from the electrolyte space. The electrode comprises at least an electrically conductive substrate and an electrochemically active coating. The gas diffusion electrode also has a coating-free edge region and it is connected to a support structure. The connection to the support structure is preferably in a coating-free edge region and is advantageously made with an electrically conductive plate which covers at least the coating-free edge region as well as an edge region that includes the electrochemically active coating thereon.

Additional objects, features and advantages of the invention will be set forth in the description which follows, and in part, will be obvious from the description, or may be learned by practice of the invention. Objects, features and advantages of the invention may be realized and obtained by means of the instrumentalities and combination particularly pointed out in the appended claims.

BRIEF DESCRIPTION OF THE DRAWINGS

The invention will be explained in more detail below with reference to the drawings, in which.

DETAILED DESCRIPTION OF A PREFERRED EMBODIMENT

Figure 1:
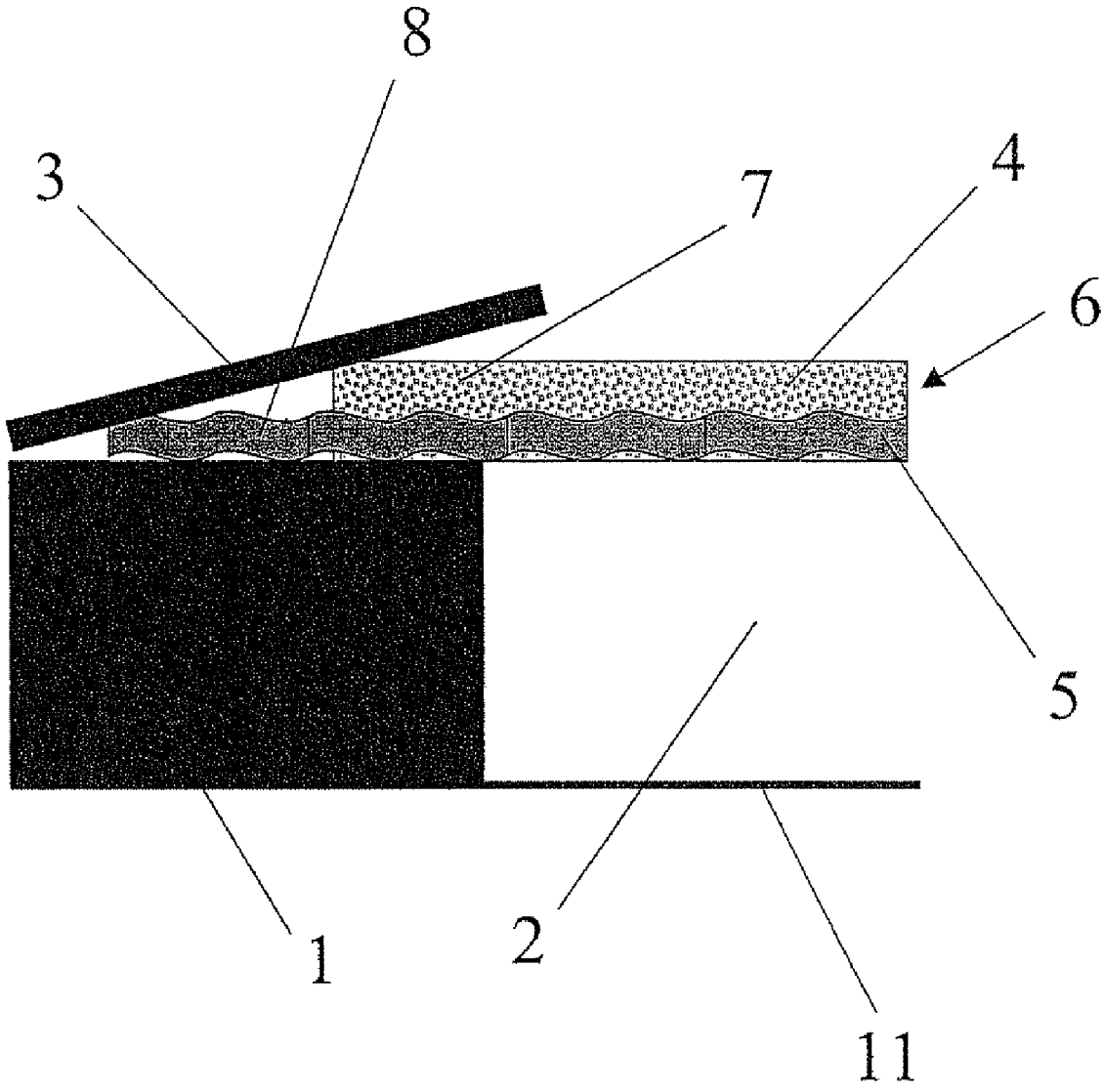
FIG. 1 shows a schematic detail of a first embodiment of the half-cell according to the invention.

An electrochemical half-cell according to the invention preferably comprises at least a gas space, which is divided into a plurality of gas pockets lying above one another. Each gas pocket is preferably separated from the electrolyte space by a gas diffusion electrode. The half-cell can be used, in particular, as a cathode half-cell for the electrolysis of aqueous alkali metal chloride solutions. The electrolyte space is filled with the electrolyte, for example, an aqueous alkali metal hydroxide solution. Gas diffusion electrodes can be used as oxygen-consuming cathodes. Gas, (e.g. air or oxygen) flows through the gas pockets. The gas is preferably introduced into a lower or a lowermost gas pocket and flows from there into gas pockets lying above in a cascade fashion. Excess gas can be discharged from an upper or an uppermost gas pocket. A suitable mode of operation for an electrolysis cell with a gas diffusion electrode according to the pressure compensation principle is described, for example, in DE-A-44 44 114, which is incorporated herein by reference in its entirety.

The gas diffusion electrode preferably includes an electrically conductive substrate and an electrochemically active coating. The electrically conductive substrate is preferably a gauze, fabric, lattice, mesh, non-woven or foam made of metal, especially nickel, silver or silver-coated nickel or any desired material. The electrochemically active coating preferably comprises a catalyst, for example silver(I) oxide, and a binder, for example, polytetrafluoroethylene (PTFE). The electrochemically active coating may be made up of one or more layers. It is also possible to provide a gas diffusion layer, for example, one made of a mixture of carbon and polytetrafluoroethylene, which can be applied to the substrate.

A representative method for making such a gas diffusion electrode is disclosed, for example, in DE-A-37 10 168, which is incorporated herein by reference in its entirety. When the coating is being applied, the coating compound penetrates the cavities of the substrate and covers the substrate.

The gas diffusion electrode of an electrochemical half-cell according to the present invention preferably has a coating-free edge region on all sides (generally four). The coating-free edge region preferably measures from 2 to 10 mm, particularly preferably from 4 to 8 mm. In order to produce the coating-free edge region, the electrochemically active coating can be removed from the edge region, together with other coatings if there are any.

In order to install a gas diffusion electrode in a half-cell of the present invention, the gas diffusion electrode can advantageously be placed on the support structure. The support structure preferably is made of the same material as that from which the half-shells of the electrolysis half-elements are made, for example, nickel in the case of chloralkali electrolysis. As is known from DE-A-44 44 114, the support structure can typically be in the form of a frame and spatially delimits the gas pocket in conjunction with the gas diffusion electrode and the back wall of the gas pocket.

The electrically conductive substrate of the gas diffusion electrode preferably rests on the support structure to an extent such that the substrate covers the support structure not only in the coating-free edge region, but also in a coated edge region. The gas diffusion electrode preferably covers the support structure as far as a coated edge region measuring from about 2 to about 8 mm, particularly preferably from about 2 to about 5 mm. The substrate of the gas diffusion electrode therefore preferably covers the support structure overall in a region of from 4 to 18 mm, particularly preferably from 2 to 13 mm.

In order to connect the gas diffusion electrode to the support structure, an electrically conductive plate, preferably made of metal, especially nickel, is placed on both a coating-free edge region, i.e. the uncoated electrically conductive substrate, as well on a coated edge region. The coated edge region which is covered by the electrically conductive plate preferably measures from about 1 to about 10 mm. Furthermore, the plate may optionally protrude beyond the substrate of the gas diffusion electrode in a region of preferably at most about 5 mm, particularly preferably at most about 3 mm. In this way, the plate can make contact with the support structure. The width of the electrically conductive plate is therefore preferably from about 3 to about 21 mm. The plate is typically pressed rather firmly onto the gas diffusion electrode and the support structure, since sufficient contact between the gas diffusion electrode and the support structure is often desirable to obtain adequate sealing and supply of current.

A gas diffusion electrode of the present invention is preferably connected to the support structure and the plate by a weld. The weld can be formed of any desired material and the formation of the weld can be conducted in the vicinity of the coating-free edge of the gas diffusion electrode. Laser welding or ultrasonic welding is preferably used. In this case, on the one hand, the ratio of the thickness of the plate to the distance between the plate and the substrate should generally be considered. For laser welding particularly, the ratio is preferably less than 0.5, particularly preferably less than 0.2. If the distance between the plate and the substrate is comparatively large, for example, when a comparatively thick coating is provided on the substrate, then this large distance can be compensated, for example, by employing a thicker plate. On the other hand, the thickness of the coating which is applied to the electrically conductive substrate should also generally be considered. If the part of the coating that rests on the substrate is larger than about 0.5 mm, and if the distance between the plate and the substrate cannot be reduced to preferably less than about 1 mm, particularly preferably less than about 0.5 mm, by pressing on the plate, then a wedge-shaped spacer can advantageously be inserted if desired between the plate and the substrate. As an alternative, it is also possible to use a thicker plate without a spacer or compensate in any way desired, if beneficial for any reason.

The electrically conductive plate preferably has a thickness of from about 0.05 to about 2 mm in some embodiments.

The plate preferably extends in the form of a frame around the gas diffusion electrode. As an alternative, it is also possible to use a plurality of plates in the form of strips which, for example, overlap at their ends or are butted or mitred. They then likewise can form a complete frame around the gas diffusion electrode for sealing in some embodiments.

In a preferred embodiment, a seal can be provided in the vicinity of the surface where the gas diffusion electrode, or the electrically conductive substrate, rests on the support structure. The seal preferably lies between the support structure and the substrate.

In another preferred embodiment, in addition or as an alternative to the seal, the coating can be rendered at least partially or completely hydrophilic in the edge region which is covered by the plate in order to produce a gas-tight connection. The hydrophilisation employed to render the coating hydrophilic can be conducted, for example, by applying a solution containing surfactant to the surface of the coating, so that the electrolyte penetrates the coating and provides sealing by capillary action.

An advantage of the half-cell according to the invention is that the gas diffusion electrode is electrically connected to the support structure via an electrically conductive plate while, at the same time, the gas space is sealed off from the electrolyte space so that substantially little or no electrolyte can enter the gas space and substantially little or no gas can enter the electrolyte space. By using the inventive arrangement, it is possible to reduce the amount electrochemically active area of the gas diffusion electrode that is lost during installation. If the loss of electrochemically active area is too large the difference between the anode area and the area of the gas diffusion electrode may also be too large. As a consequence, the electrolysis cell would have to be operated with an increased current density, and therefore an increased voltage, especially in the case of retrofitting a membrane system for GDE operation, if a commensurate reduction in the production capacity is not made.

FIG. 1 shows a gas space 2 of the electrochemical half-cell with a support structure 1 at the edge of the gas space 2. A gas diffusion electrode 6, consisting of an electrically conductive substrate 5 and an electrochemically active coating 4, rests on the support structure 1. The support structure 1, the gas diffusion electrode 6 and the back wall 11 form the gas space 2 as a gas pocket.

The gas diffusion electrode 6 has a coating-free edge region 8, where the coating has been removed and the substrate 5 is exposed. The coating 4 penetrates through the substrate 5 and covers it. The coating-free edge 8 of the gas diffusion electrode 6 and the coated edge region 7 rest on the support structure 1. An electrically conductive plate 3 rests on the gas diffusion electrode 6 so that it covers the coating-free edge 8 and the coated edge region 7. It furthermore protrudes beyond the coating-free edge 8, where it comes to lie on the support structure 1. In the vicinity of the coating-free edge 8, the plate 3 is connected to the gas diffusion electrode 6 and the support structure 1, preferably by a weld.

Figure 2:
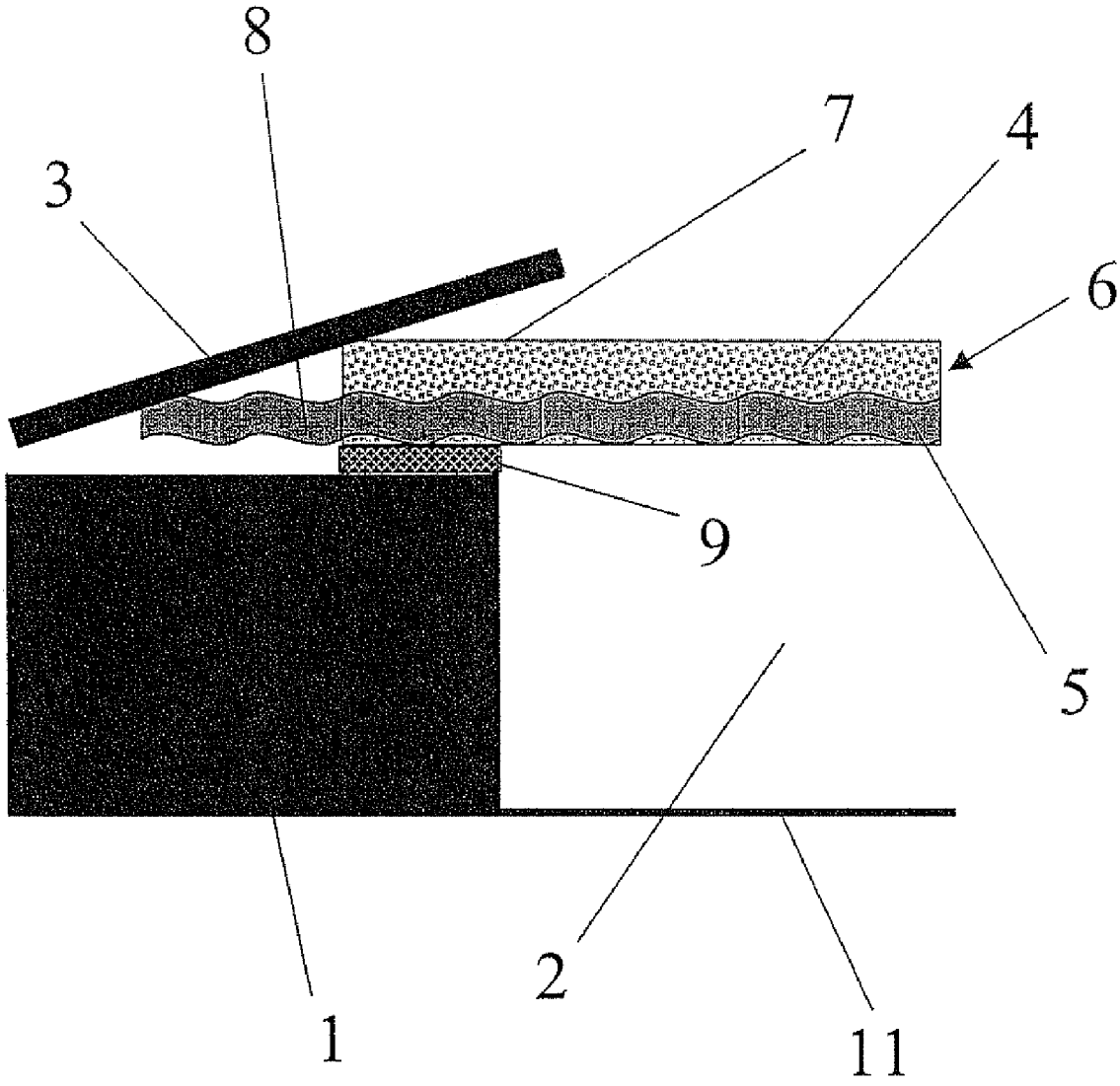
FIG. 2 shows a schematic detail of a second embodiment with a seal.

FIG. 2 represents another embodiment, with components which are the same or similar having the same reference numbers. The embodiment differs from the one represented in FIG. 1 in that a seal 9 is provided between the support structure 1 and the gas diffusion electrode 6.

Figure 3:
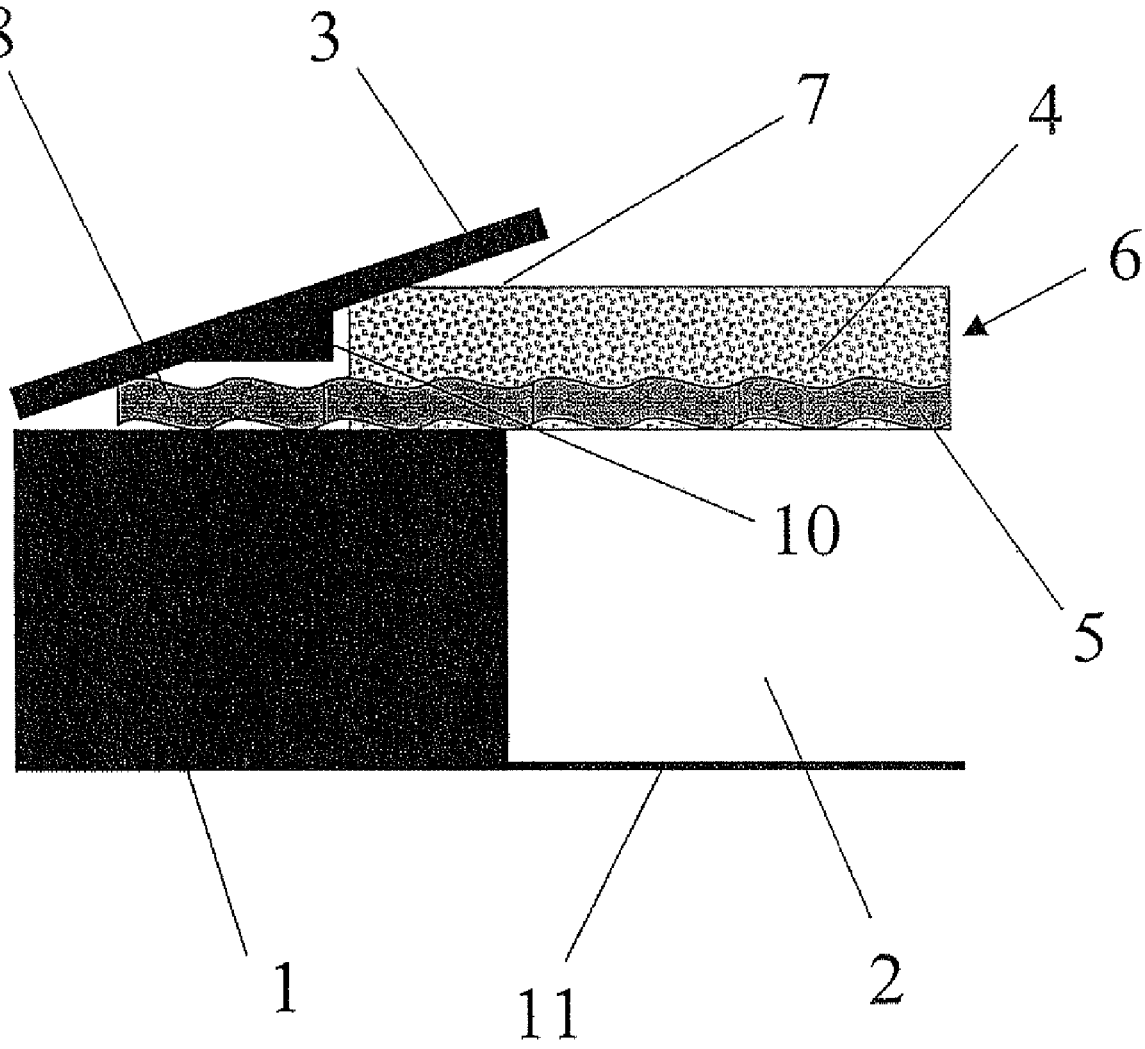
FIG. 3 shows a schematic detail of a third embodiment with a wedge-shaped spacer.

In a third embodiment in FIG. 3, components which are the same or similar are likewise provided with the same reference numbers. In comparison with the embodiment shown in FIG. 1, a wedge-shaped spacer 10 is inserted between the electrically conductive plate 3 and the coating-free edge 8. A spacer 10 is to be provided when the coating 4 of the gas diffusion electrode 6 is so thick that the distance between the plate 3 and the substrate 5 is too great for the plate 3 to be connected to the gas diffusion electrode 6 and the support structure 1.

EXAMPLES

Example 1

Homogeneous Gas Diffusion Electrode

A gas diffusion electrode of an electrically conductive substrate and an electrochemically active layer made of a mixture of silver (I) oxide and PTFE was employed. The substrate of the gas diffusion electrode included a nickel gauze, in which the wire thickness was 0.14 mm and the mesh width was 0.5 mm. The layer containing silver (I) oxide/PTFE was removed from the gas diffusion electrode in an edge region measuring 4 mm. A PTFE seal was placed between the support structure and the gas diffusion electrode. A metal strip made of nickel with a thickness of 1 mm and a width of 8 mm was positioned so as to cover the coating-free edge completely, as well as an edge region of the gas diffusion electrode measuring 4 mm. The nickel strip was then pressed onto the support structure and connected to the substrate and the support structure by laser welding.

Example 2

Gas Diffusion Electrode with Dual-Layer Design

A gas diffusion electrode was used which had two layers: a gas diffusion layer, consisting of PTFE and carbon, and an electrochemically active layer, of PTFE, carbon and silver. The electrically conductive substrate of the gas diffusion electrode included a gauze made of silver-coated nickel, in which the wire thickness was 0.16 mm and the mesh width was 0.46 mm. The coating, which included a gas diffusion layer and an electrochemically active layer, was removed from the gas diffusion electrode in an edge region measuring 4 mm. A PTFE seal was placed between the support structure and the gas diffusion electrode. The coating was rendered hydrophilic in an edge region of the gas diffusion electrode. To this end, it was coated with a solution containing surfactant (here Triton®-X-100 solution, Merck, was used by any other type can also be used if desired). A metal strip made of nickel with a thickness of 1 mm and a width of 8 mm was positioned so as to cover the coating-free edge completely, as well as an edge region of the gas diffusion electrode measuring 4 mm. The nickel strip was then pressed onto the support structure and connected to the substrate and the support structure by laser welding.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defied by the appended claims and their equivalents.

All documents referred to herein are specifically incorporated herein by reference in their entireties.

As used herein and in the following claims, articles such as "the", "a" and "an" can connote the singular or plural.

The invention claimed is:

1. An electrochemical half-cell, comprising a gas space, an electrolyte space and a gas diffusion electrode in the form of a cathode or anode, wherein said gas diffusion electrode separates the gas space from the electrolyte space and comprises at least an electrically conductive substrate and an electrochemically active coating, further wherein said gas diffusion electrode has a coating-free edge region and is capable of being connected to a support structure, wherein when the gas diffusion electrode is connected to the support structure, said connection is made in the coating-free edge region of the substrate with an electrically conductive plate, said conductive plate electrically contacting and covering the conductive substrate in the coating-free edge region and electrically contacting and covering a portion of the electrochemically active coating.

2. The electrochemical half-cell of claim 1, wherein the coating-free edge region measures from about 2 to about 10 mm.

3. The electrochemical half-cell of claim 1, wherein the portion of the electrochemically active coating which is covered by the electrically conductive plate, measures from about 2 to about 8 mm.

4. The electrochemical half-cell of claim 1, wherein the gas diffusion electrode is connected to the support structure via the electrically conductive plate by a weld.

5. The electrochemical half-cell of claim 1, wherein the electrically conductive plate has a thickness of from about 0.05 to about 2 mm and a width of from about 3 to about 21 mm.

6. The electrochemical half-cell of claim 1, wherein the electrically conductive plate comprises metal.

7. The electrochemical half-cell of claim 1, further comprising a seal provided in a vicinity of the surface by which the gas diffusion electrode rests on the support structure.

8. The electrochemical half-cell of claim 1, further comprising a surfactant solution applied in the portion of the coating that is covered by the electrically conductive plate.

9. The electrochemical half-cell of claim 6, wherein said electrically conductive plate comprises nickel.

10. An electrochemical half-cell comprising a support, a gas diffusion electrode electrically connected to the support via an electrically conductive plate, wherein gas space in said half-cell is sealed off from electrolyte space in said half-cell so that substantially little electrolyte can enter the gas space and substantially little gas can enter the electrolyte space wherein said gas diffusion electrode comprises at least an electrically conductive substrate and an electrochemically active coating, said gas diffusion electrode having a coating-free edge region, and wherein said electrically conductive plate electrically contacts and covers the conductive substrate in the coating-free edge region and electrically contacts and covers a portion of the electrochemically active coating.

11. An electrochemical half cell comprising a support and a gas diffusion electrode said gas diffusion electrode being connected to said support via an electrically conductive plate, wherein said gas diffusion electrode comprises at least an electrically conductive substrate and an electrochemically active coating, said gas diffusion electrode having a coating-free edge region, and wherein said electrically conductive plate electrically contacts and covers the conductive substrate in the coating-free edge region and electrically contacts and covers a portion of the electrochemically active coating.

12. The electrochemical half cell of claim 11, wherein said electrochemically active coating comprises silver and PTFE.

13. The electrochemical half cell of claim 11, wherein said substrate of said electrode further includes a gas diffusion layer.

14. The electrochemical half cell of claim 12, further comprising a PTFE seal between the support and the gas diffusion electrode.

15. The electrochemical half cell of claim 11, wherein at least a portion of said coating is hydrophilic.

16. A method for reducing the electrochemically active area lost due to installation of a gas diffusion electrode in a half cell, said method comprising sealing off gas space from electrolyte space in said half cell using an electrically conductive plate, wherein said gas diffusion electrode comprises at least an electrically conductive substrate and an electrochemically active coating, said gas diffusion electrode having a coating-free edge region, and wherein said electrically conductive plate electrically contacts and covers the conductive substrate in the coating-free edge region and electrically contacts and covers at least a portion of the electrochemically active coating.

17. The method of claim 16, wherein said plate is welded to said conductive substrate.

18. A method installing a gas diffusion electrode in a half cell comprising removing a portion of electrochemically active coating from said electrode to form at least one coated and at least one uncoated region thereof.

placing said electrode on a support of said half cell, wherein said electrode is adjacent to said support in both a coated and an uncoated region thereof, and connecting said support to said electrode via an electrically conductive plate, wherein said electrically conductive plate electrically contacts and covers at least a portion of both said coated and uncoated region of said gas diffusion electrode.

19. The method of claim 18, wherein said electrically conductive plate comprises metal.

20. The method of claim 18, further comprising placing a seal between the support and the electrode.

21. The method of claim 18, wherein said support comprises nickel.

22. The electrochemical half cell of claim 11, wherein said support comprises nickel.

* * * * *